United States Patent [19]

Wamsley et al.

[11] Patent Number: 4,498,663

[45] Date of Patent: Feb. 12, 1985

[54] SIGNATURE HANDLING APPARATUS FOR DETECTION OF SHORT SIGNATURE GROUPS

[75] Inventors: Richard D. Wamsley, Swanton, Vt.; David J. Polman, Brook Park, Ohio

[73] Assignee: Harris Graphics Corporation, Melbourne, Fla.

[21] Appl. No.: 535,034

[22] Filed: Sep. 23, 1983

[51] Int. Cl.[3] ..... B65H 39/02

[52] U.S. Cl. ..... 270/54; 198/644

[58] Field of Search ..... 270/54, 55, 56, 58; 198/644

[56] References Cited

U.S. PATENT DOCUMENTS

| | | | |
|---|---|---|---|
| 3,561,752 | 2/1971 | McCain et al. | 270/54 X |
| 3,664,655 | 5/1972 | McCain et al. | 270/54 |
| 3,819,173 | 6/1974 | Anderson et al. | 270/58 |
| 4,050,686 | 9/1977 | McCain et al. | 270/54 |
| 4,162,066 | 7/1979 | McCain et al. | 270/54 |
| 4,170,346 | 10/1979 | Murray et al. | 270/54 |

*Primary Examiner*—E. H. Eickholt

*Attorney, Agent, or Firm*—Yount & Tarolli

[57] ABSTRACT

An improved signature handling apparatus includes a plurality of signature feeders which are operatable to form groups of signatures on a conveyor. Detectors are associated with the signature feeders to detect a signature misfeed and a resulting defective group of signatures. The conveyor sequentially transports the groups of signatures to a delivery assembly which directs groups of signatures containing a predetermined number of signatures to a trimmer. The delivery assembly directs defective groups of signatures containing less than the predetermined number of signatures to a reject tray. The delivery assembly includes a nip through which the signatures are fed from the conveyor. The size of the nip can be varied by varying the distance between rollers disposed on opposite sides of the nip. A control assembly decreases the distance between the centers of rotation of the rollers to decrease the size of the nip when a group of signatures, containing less than the predetermined number of signatures, is to be fed through the nip.

10 Claims, 5 Drawing Figures

SIGNATURE HANDLING APPARATUS FOR DETECTION OF SHORT SIGNATURE GROUPS

BACKGROUND OF THE INVENTION

This invention relates to a new and improved apparatus for handling signatures and more specifically to an apparatus having a delivery assembly which includes a nip through which groups of signatures are fed before being directed to either an additional signature handling apparatus or a reject location.

A known commercially available inserter-stitcher-trimmer has a plurality of signature feeders which are disposed along a saddle type conveyor. As a signature receiving location on the conveyor moves past of each of the signature feeders in turn, a group of signatures is assembled. After this group of signatures has been inspected and stitched, it is moved to a delivery assembly. At the delivery assembly, the group of signatures passes through a nip and is directed to either a trimmer or a reject location.

During operation of this known inserter-stitcher-trimmer, a misfeed may occur at one of the signature feeders with a resulting formation of a defective group of signatures containing less than a predetermined number of signatures. When a signature misfeed is detected, the signature feeders downstream from the location where the misfeed occurred are rendered ineffective to feed additional signatures onto the defective group of signatures. Therefore, when a misfeed occurs at one of the first signature feeders, a very thin group of signatures is formed.

The nip in the delivery assembly is set to have a size which accommodates a numerically perfect group of signatures, that is a group of signatures containing a predetermined number of signatures. When an attempt is made to feed a thin defective group of signatures through the nip, the relatively large size of the nip may prevent the thin group of signatures from being fed through the delivery assembly. This can result in jamming of the apparatus.

SUMMARY OF THE PRESENT INVENTION

The present invention provides a new and improved signature handling apparatus having a delivery assembly in which the size of a nip through which signatures are fed is reduced to accommodate defective groups of signatures containing less than a predetermined number of signatures. Once the defective group of signatures has passed through the nip, the size of the nip is increased to accommodate groups of signatures containing the predetermined number of signatures. The delivery assembly includes a pair of rollers which are disposed on opposite sides of the nip. When a defective group of signatures is to be fed through the nip, the distance between the rollers is reduced to decrease the size of the nip.

An apparatus for varying the size of the nip in the delivery assembly includes a cam and cam follower. The cam and cam follower are relatively movable to adjust the size of the nip.

Immediately before a defective group of signatures containing less than the predetermined number of signatures is to pass through the nip, the cam and cam follower move relative to each other to move at least one of the rollers and decrease the size of the nip. Contemporaneously with the reduction in the size of the nip, a gate is pivoted from a normal feed position to a reject position so that the defective group of signatures is directed to a reject location as it leaves the nip. Immediately after the defective group of signatures has passed through the nip, the cam and cam follower are moved relative to each other to move at least one of the rollers and increase the size of the nip back to its original size to accommodate groups of signatures containing the predetermined number of signatures.

Accordingly, it is an object of this invention to provide a new and improved signature handling apparatus in which a detector means detects a misfeed by a signature feeder and the resulting formation of a defective group of signatures and wherein the size of a delivery nip through which groups of signatures are fed is decreased to accommodate the defective group of signatures.

Another object of this invention is to provide a new and improved signature handling apparatus which includes a nip through which groups of signatures are fed and wherein a nip size control apparatus decreases the size of the nip from an initial size to a reduced size to accommodate a defective group of signatures containing less than a predetermined number of signatures and, after the defective group of signatures has passed through the nip, increases the size of the nip from the reduced size back to the initial size.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Inverter-Stitcher-Trimmer Assembly

Figure 1:
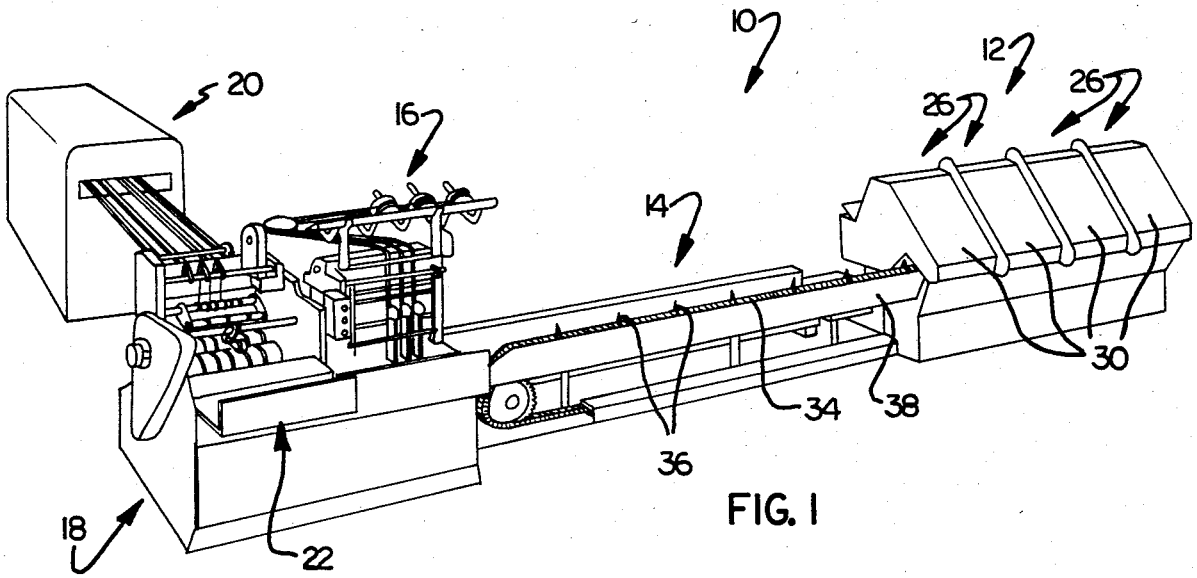
FIG. 1 is a simplified illustration of an inverter-stitcher-trimmer assembly.
Figure 2:
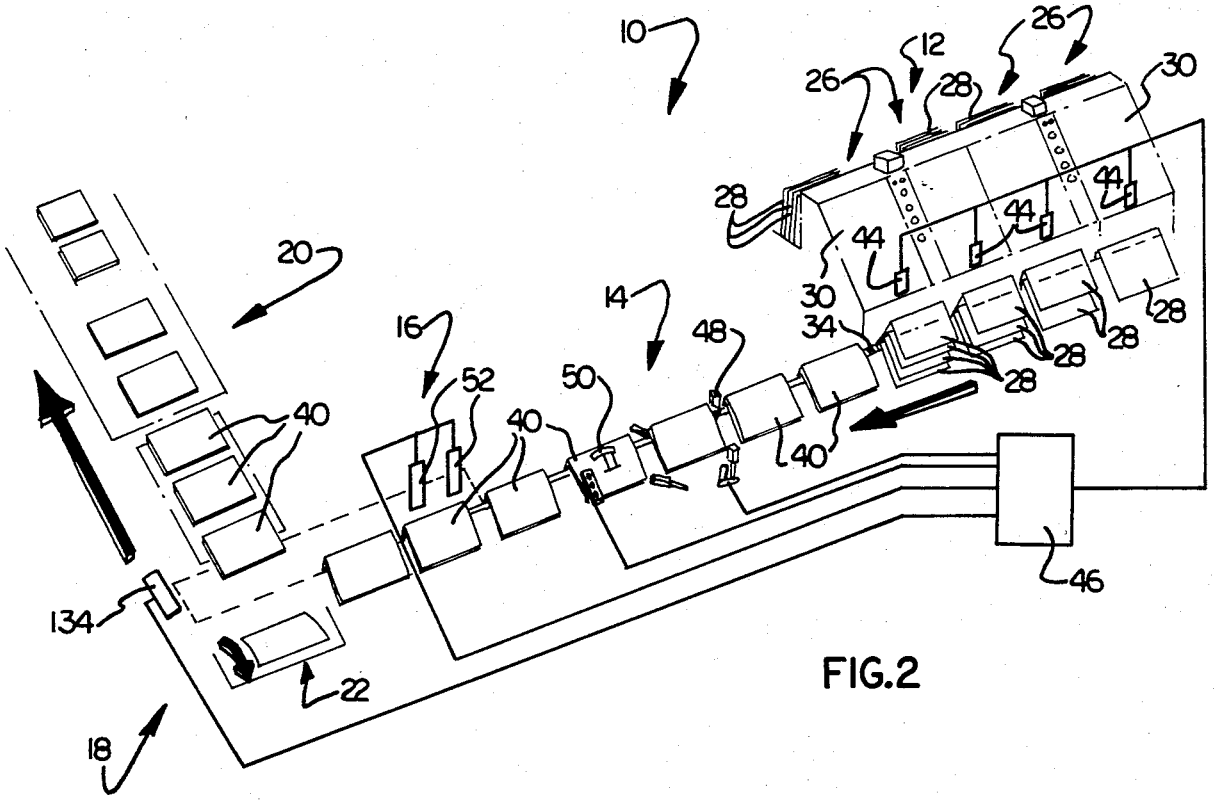
FIG. 2 is a schematic illustration of the manner in which groups of signatures are formed on a conveyor in the inverter-stitcher-trimmer assembly of FIG. 1 and are conducted from a delivery assembly to either a trimmer or a reject location.

An inverter-stitcher-trimmer assembly 10 for forming, stitching and trimming groups of signatures is illustrated in FIGS. 1 and 2. The inverter-stitcher-trimmer assembly 10 includes a collator unit 12 which forms groups of signatures on a conveyor 14. The conveyor 14 conducts the groups of signatures through a stitcher assembly 16 where the groups of signatures are stapled. A delivery assembly 18, constructed in accordance with the present invention, directs numerically perfect groups of signatures containing the desired number of signatures to a trimmer assembly 20. The delivery assembly 18 directs defective or numerically imperfect groups of signatures containing less than the desired number of signatures to a reject tray 22.

The collator unit 12 includes a plurality of vertical hoppers 26 which hold signatures 28 (FIG. 2) which are fed by signature feeders 30 onto the conveyor 14. The signature feeders 30 are of a known construction and include a rotor drum which engages a signature 28 in one of the hoppers 26 and transfers the signature to a pair of opener drums which open the signature and drop it onto the saddle type conveyor 14.

The conveyor 14 includes an endless collator chain 34 having pusher fingers 36 (FIG. 1) which engage the trailing edge portion of a group of signatures to move the signatures along a saddle 38 past each of the feeders 30. As a pusher finger 36 moves past the first feeder 30, an initial signature is dropped onto a receiving location on the collator chain 14. As this receiving location moves past each of the signature feeders 30 in turn, a signature is deposited at the receiving location, in the manner illustrated schematically in FIG. 2. This results in the formation of a group of signatures 40 containing a predetermined number of signatures.

During operation of the collator unit 12, an occasional misfeed may occur in one of the signature feeder units 30 with a resulting failure to feed a signature onto the chain 34. This results in the formation of a numerically imperfect or defective group of signatures containing less than the predetermined number of signatures. A detector unit 44 (FIG. 2) is associated with each of the signature feeders 30 to detect the occurrence of a misfeed.

Upon the occurrence of a misfeed, the control assembly 46 (see FIG. 2) renders the signature feeders 30 downstream of the location where the misfeed occurred ineffective to feed signatures. Thus, when a signature misfeed occurs, the detector 44 at the location where the misfeed occurred signals the control assembly 46. The control assembly 46 then renders the downstream signature feeders 30 ineffective to feed a signature whenever the location on the conveyor chain at which a misfeed occurred passes through a downstream signature feeder 30. This results in the conveyor 14 transporting both thick groups 40 of signatures containing a predetermined number of signatures and thin groups of signatures containing only the signatures which were fed into the group before the misfeed occurred.

After the signatures have passed out of the collator unit 12, they move through a long/skew signature group detector 48 (FIG. 2) which detects when a group of signatures is defective due to misorientation of one or more signatures. A signature calipering unit 50 detects the thickness of the signatures. If a group 40 of signatures is defective due to either misorientation of a signature or having more or less than the desired number of signatures, this fact is transmitted to the control assembly 46 by either the long/skew signature detector 48 or the caliper 50.

When the groups of signatures are moved into the stitcher assembly 16, they leave the conveyor chain 34 and are moved along the saddle 38 by shuttle assemblies (not shown). The correctly formed groups of signatures are stitched in the stitcher assembly 16 by staplers 52. The control assembly 46 renders the staplers 52 ineffective to stitch defective groups of signatures.

The conveyor 14 transports the signatures from the stitcher assembly 16 to the delivery assembly 18. The delivery assembly 18 sorts the correctly formed groups of signatures from defective groups of signatures. The correctly formed groups of signatures are directed by the delivery assembly 18 toward the trimmer 20. The defective groups of signatures are directed to the reject tray 22. The operation of the delivery assembly 18 is controlled by the control assembly 46.

The general construction and mode of operation of the inverter-stitcher-trimmer assembly 10 is well known. Thus, the inverter-stitcher-trimmer assembly 10 has the same general construction as the "Pacesetter 850" and "Pacesetter 750" inverter-stitcher-trimmers sold by Harris Corporation, Bindery Systems Division of 145 Keep Court, Elyria, Ohio. Since the general construction of the inverter-stitcher-trimmer assembly 10 is well known, it will not be further described herein to avoid prolixity of description.

Delivery Assembly—General Description

In accordance with a feature of the present invention, the delivery assembly 18 is operable to feed both correctly formed groups of signatures containing a predetermined number of signatures and defective groups of signatures containing less than the predetermined number of signatures without jamming. To accomplish this, the size of a nip 56 (FIG. 3) in the delivery assembly 18 is initially set to accommodate groups of signatures containing the predetermined number of signatures. When a defective group of signatures is to be fed through the nip 56, the size of the nip is reduced (FIG. 5) to enable a thin defective group of signatures to be firmly gripped. Once the defective group of signatures has passed through the nip 56, the size of the nip is increased back to the initial size (FIG. 3) to accommodate a relatively thick group of signatures containing the predetermined number of signatures.

The nip 56 is formed between a pair of pick up rollers 60 and 62 which are disposed on opposite sides of the nip. During operation of the inverter-stitcher-trimmer assembly 10, the roller 60 is continuously rotated in a counterclockwise direction and the roller 62 is continuously rotated in a clockwise direction (as viewed in FIGS. 3 and 5). A nip size control assembly 64 (FIG. 3) is operable to vary the distance between horizontal central axes of the counterrotating rollers 60 and 62 to thereby vary the size of the nip 56.

The nip size control assembly 64 is initially set so that the nip 56 has a size at which the rollers 60 and 62 clampingly grip a numerically perfect group of signatures 40 as it is fed upwardly from the saddle 38 by a tucker blade 68. As a leading or folded edge portion of the group of signatures enters the nip 56, the rotating rollers 60 and 62 clamp against opposite sides of the group of signatures to move it upwardly against the gate member 70. The gate member 70 directs the correctly formed group of signatures toward the left (as viewed in FIG. 3) into a feed nip 72 formed between upper and lower feed belts 74 and 76. The feed belts 74 and 76 are continuously moving in the directions indicated by the arrow in FIG. 3 to transport the correctly formed group of signatures to the trimmer assembly 20 (FIG. 2).

Figure 3:
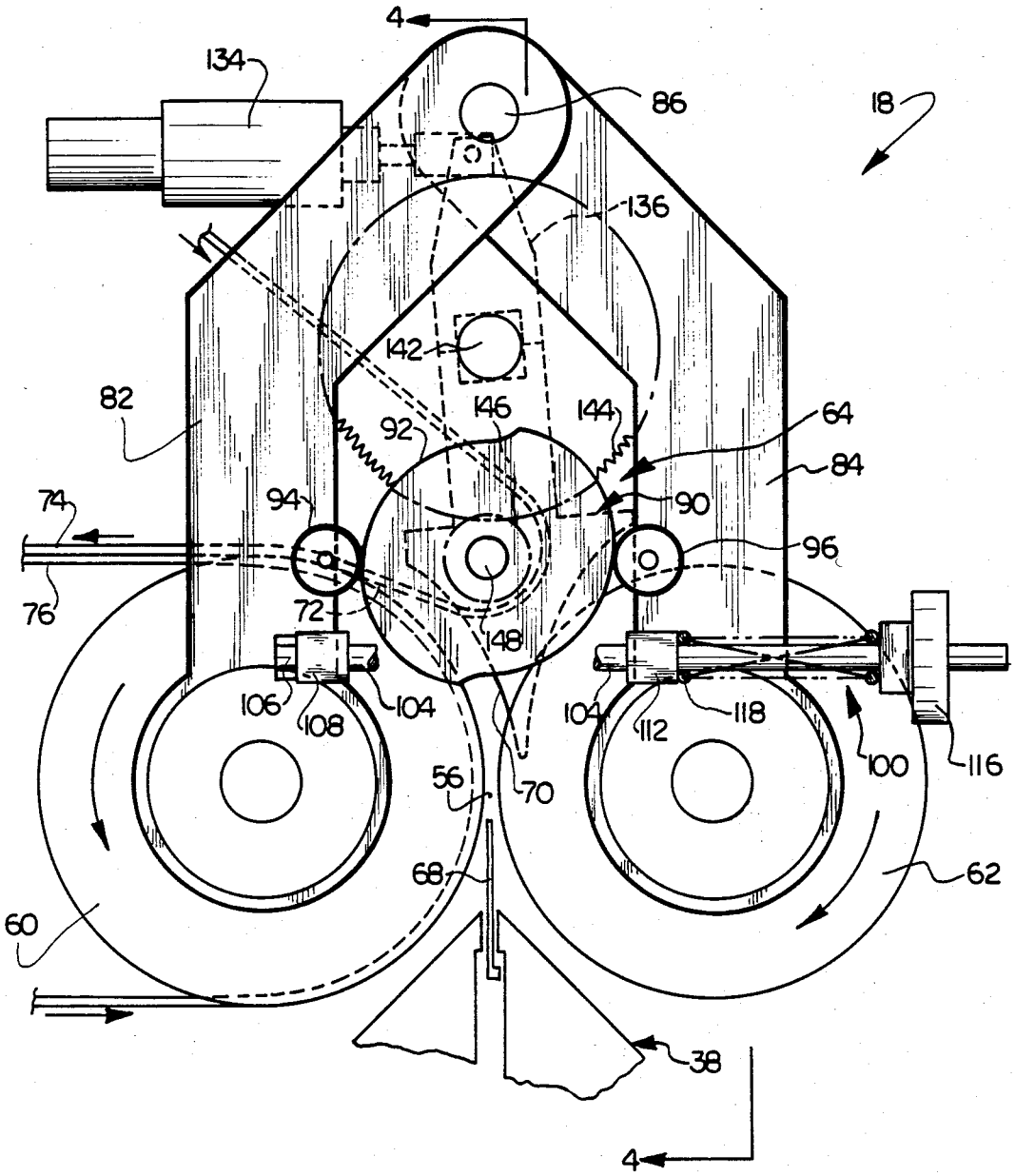
FIG. 3 is a simplified illustration of a delivery assembly constructed in accordance with the present invention, the delivery assembly being shown with a signature feed nip sized to accommodate a group of signatures containing a predetermined number of signatures and a gate set to direct the group of signatures toward the trimmer.
Figure 5:
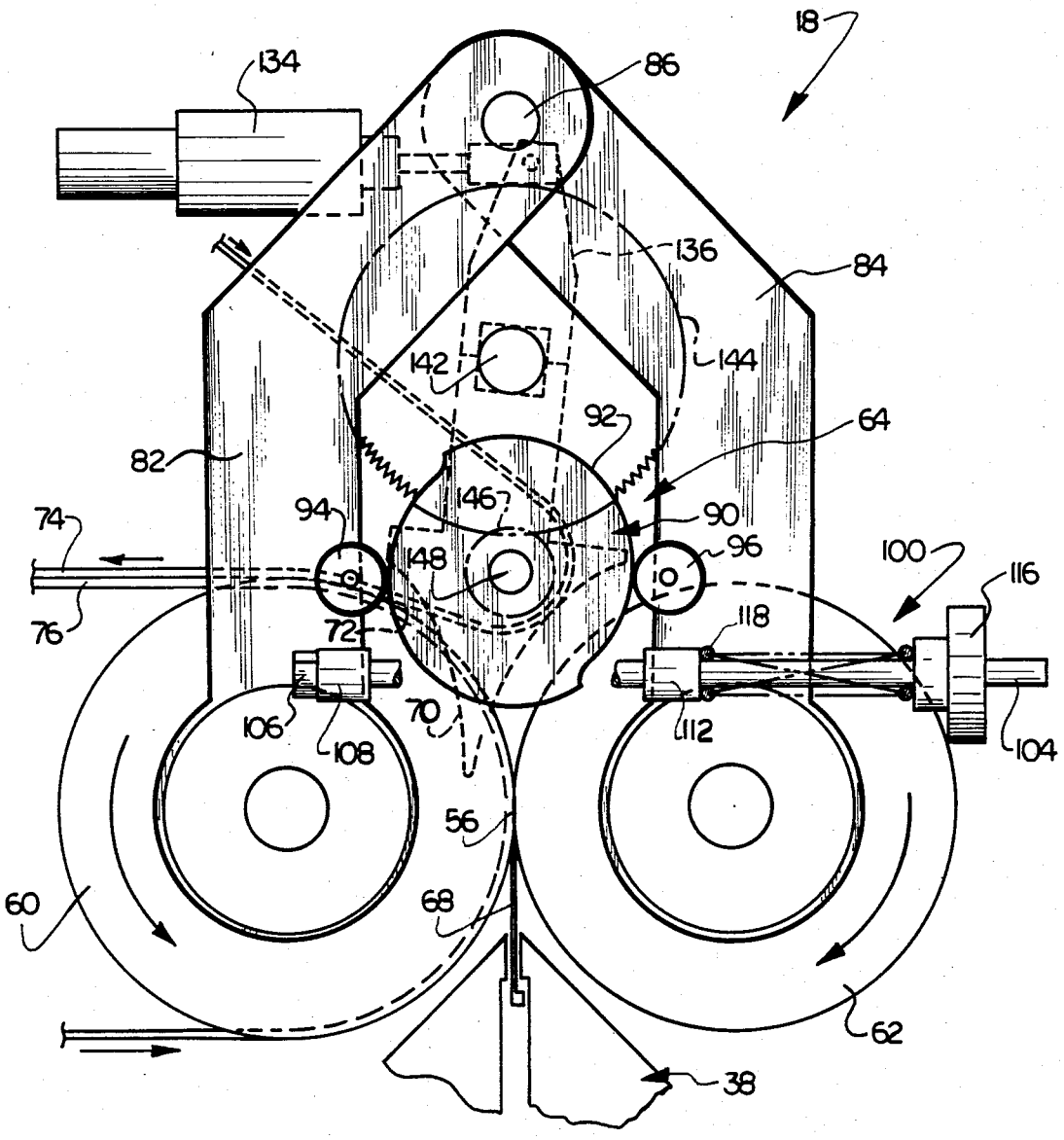
FIG. 5 is an elevational view, generally similar to FIG. 3, of the delivery assembly with the size of the nip reduced to accommodate a defective group of signatures containing less than a predetermined number of signatures, the gate being shown in a reject position to direct the defective group of signatures to a reject location.

When the control assembly 46 (FIG. 2) detects that a defective group of signatures will be fed through the delivery assembly 18 on a next succeeding upward stroke of the tucker blade 68, the control assembly 46 actuates the nip size control assembly 64 to decrease the size of the nip 56 from the initial size shown in FIG. 3 to the relatively small size shown in FIG. 5. At the same time, the gate 70 is pivoted from the normal position shown in FIG. 3 to the reject position shown in FIG. 5. When the gate 70 is in the reject position shown in FIG. 5, it engages the leading end portion of a defective group of signatures as it exits from the nip 56 and directs the group of signatures toward the right (as viewed in FIG. 5) to the reject tray 22. Once the defective group of signatures has passed through the nip 56, the control assembly 46 again actuates the nip size control assembly 64 to increase the size of the nip 56 from the reduced size shown in FIG. 5 to the initial size shown in FIG. 3.

Roller Mounting

To enable the size of the nip 56 to be varied, the rollers 60 and 62 are rotatably mounted on a pair of movable support arms 82 and 84. The support arms 82 and 84 are pivotally mounted on a support pin 86 (see FIGS. 3, 4 and 5). Although only the support arms 82 and 84 have been shown in the drawings, it should be understood that a second pair of support arms are connected with the opposite axial end portions of the rollers 60 and 62. The pairs of support arms cooperate to support the rollers 60 and 62 for rotation about horizontal axes and to enable the axes of rotation of the rollers to move toward and away from each other to vary the size of the nip 56.

When the size of the nip 56 is to be increased, the arms 82 and 84 are moved outwardly away from each to separate the rollers 60 and 62. When the size of the nip 56 is to be reduced, the support arms 82 and 84 are moved inwardly toward each other to decrease the distance between the peripheries of the rollers 60 and 62.

Although it is preferred to mount both of the rollers 60 and 62 for movement, it is contemplated that it may be desirable to mount only one of the rollers for movement relative to the other. Thus, the roller 60 could, if desired, be mounted for rotation about a fixed axis with the roller 62 mounted on a support structure for movement toward and away from the roller 60. Although it is preferred to use support arms 82 and 84 to movably mount the rollers 60 and 62, it is contemplated that the rollers could be mounted on slide assemblies if desired.

Nip Size Control

The nip size control assembly 64 is operable to effect relative movement between the rollers 60 and 62 to vary the size of the nip 56. The nip size control assembly 64 includes a rotatable cam 90 having an outer side surface 92 which is engaged by a pair of cam followers or rollers 94 and 96. The cam followers 94 and 96 are disposed on the support arms 82 and 84 and are urged into abutting engagement with the peripheral surface 92 of the cam 90 by a biasing assembly 100.

The biasing assembly 100 includes a rod 104 having a head end portion 106 which abuttingly engages a guide 108 through which the rod 104 extends. The guide 108 is fixedly connected with the support arm 82 for the roller 60. The rod 104 also extends through and is slidable relative to a guide 112 which is fixedly connected with the support arm 84.

The right end portion (as viewed in FIGS. 3 and 5) of the rod 104 is externally threaded to receive an internally threaded knob 116. A biasing spring 118 extends between the knob 116 and the guide 112. The pressure of the spring 118 against the guide 112 and the force applied to the guide 108 by the head end 106 of the rod 104 pulls the two roller support arms 82 and 84 inwardly toward each other. The force applied against the arms 82 and 84 by the biasing assembly 100 can be adjusted by rotating the knob 116.

In order to set the initial size of the nip 56 to accommodate the thickness of a group of correctly formed signatures, a knob 124 (FIG. 4) of an adjustment assembly 126 is manually rotated. Rotation of the knob 12 rotates the cam 90 relative to the cam followers 94 and 96. It should be noted that the adjustment assembly 126 has been omitted in FIGS. 3 and 5 for purposes of clarity of illustration.

Rotation of the adjustment knob 124 rotates the cam 90 to change the position of a variable radius ramp portion of the cam surface 92 relative to the cam followers 94 and 96. Thus, as the cam 90 is rotated in a clockwise direction (as viewed in FIG. 3), the radius of the ramp portion of the cam surface 92 increases to separate the cam followers 94 and 96. This results in outward pivotal movement of the arms 82 and 84 to separate the rollers 60 and 62 and increase the size of the nip 56. Similarly, if the adjustment knob 124 and cam 90 are rotated in a counterclockwise direction (as viewed in FIG. 3) the radius of the ramp portion of the cam surface 92 decreases so that the cam followers 94 and 96 move together to reduce the size of the nip 56.

Suitable indicia 130 is disposed adjacent to the knob 124 to provide an operator with an indication of the size of the nip 56. The indicia 130 facilitate adjusting the nip 56 to enable the pullout rollers 60 and 62 to firmly grip a correctly formed group of signatures as it is moved upwardly into the nip by the tucker blade 68.

When the control assembly 46 (FIG. 2) detects that a defective group of signatures containing less than the predetermined number of signatures to be fed through the nip 56, the control assembly 46 effects operation of the nip adjustment assembly 64 to decrease the size of the nip 56 from the initial size shown in FIG. 3 to the reduced size shown in FIG. 5. When a defective group of signatures moves into the delivery assembly 18 and is to be raised by the tucker blade 68, the control assembly actuates a piston and cylinder type fluid motor 134 to pivot a drive lever 136 (see FIG. 4) in a clockwise direction (as viewed in FIG. 3). Thus, the control assembly 46 effects actuation of a valve to port high pressure fluid to the motor 134 to operate the motor from the retracted position of FIG. 3 to the extended position of FIG. 5.

Figure 4:
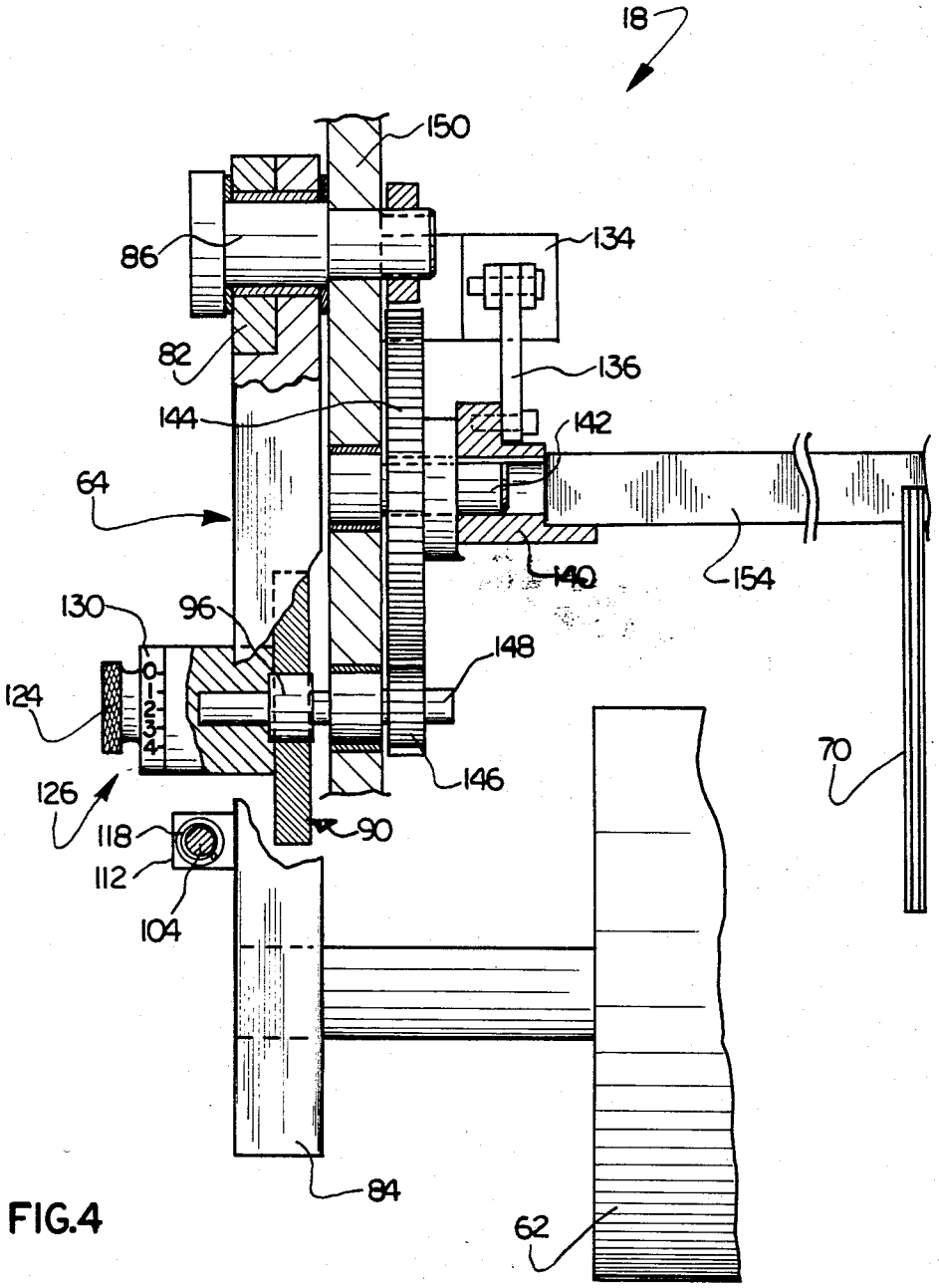
FIG. 4 is a fragmentary side elevational view of the delivery assembly of FIG. 3 illustrating a motor which is actuated to drive a pair of gears to rotate a cam to vary the size of the nip through which the signatures pass.

Operation of the motor 134 from the retracted position of FIG. 3 to the extended position of FIG. 5 pivots the link 136 to rotate a drive coupling 140 (FIG. 4). The drive coupling 140 is keyed to a stub shaft 142 which is fixedly connected with a drive gear 144. Therefore, rotation of the coupling 140 through a segment of a circle by the motor 134 also rotates the drive gear 144 through a segment of a circle.

The drive gear 144 is disposed in meshing engagement with a relatively small diameter pinion gear 146. The pinion gear 146 and cam 90 are fixedly connected to a shaft 148 which is mounted on a frame or base 150. Therefore, rotation of the drive gear 144 rotates the pinion gear 146 and cam 90.

When the motor 134 is operated from the retracted condition of FIG. 3 to the extended condition of FIG. 5, the drive arm 136 and gear 144 are rotated in a clockwise direction (as viewed in FIGS. 3 and 5). This results in rotation of the pinion gear 146 and cam 90 in a counterclockwise direction (as viewed in FIGS. 3 and 5). Counterclockwise rotation of the cam 90 results in the cam followers 94 and 96 moving down the ramp portion of the outer side surface 92 of the cam onto the constant radius dwell portion of the cam surface. As the cam followers 94 and 96 move down the ramp portion of the cam surface 92, the rollers 60 and 62 move toward each other to reduce the size of the ramp 56.

The extent to which the position of engagement of the cam followers 94 and 96 move along the dwell portion of the outer side surface of the cam 90 will depend upon the initial setting of the cam. Thus, if the cam is set for a relatively thick group of signatures, rotation of the cam 90 will result in the rollers 94 and 96 moving primarily along the ramp portion of the cam surface through a relative small distance along the dwell portion of the cam surface. Conversely, if the cam 90 is initially set for a relatively thin group of signatures, the rollers 94 and 96 will move a relatively short distance along the ramp portion of the cam surface 92 and will move a relatively long distance along the constant radius dwell portion of the cam surface.

When the size of the nip 56 is to be increased from the reduced size shown in FIG. 5 to the initial size shown in FIG. 3, the piston and cylinder type motor 134 is retracted to pivot the arm 136 in a counterclockwise direction (as viewed in FIG. 5). This results in the cam 90 being rotated in a clockwise direction. As the cam 90 is rotated in a clockwise direction, the areas of engagement of the rollers 94 and 96 with the outer side surface 92 of the cam moves from the dwell portion to the ramp portion of the cam surface. Of course, this results in the roller support arms 82 and 84 being moved apart to separate the rollers 60 and 62 and increase the size of the nip 56.

The extent of rotation of the cam 90 with operation of the motor 134 depends upon the arcuate distance through which the drive arm 136 is moved and the gear ratio between the drive gear 144 and pinion gear 146. In one embodiment of the invention, the drive arm 136 was moved through approximately 10 degrees of arcuate movement by operation of the motor 134. In this embodiment of the invention, the drive gear 144 was approximately four times as large as the pinion gear 146. This resulted in the cam 90 being rotated through approximately 40 degrees upon operation of the motor 134. Of course, the relationship between the motor 134 and drive arm 136 can be changed to change the arcuate distance through which the drive arm 136 is pivoted. In addition, the relative sizes of the drive gear 144 and pinion gear 146 can be changed to change the ratio between the gears.

The gate member 70 is fixedly connected with a square shaft 154 (see FIG. 4) which is in turn fixedly gripped by the drive coupling 140. Therefore, operation of the motor 134 is effective to pivot the gate member 70 between the normal position shown in FIG. 3 directing correctly formed signatures toward the trimmer assembly 20 and the reject position shown in FIG. 5 directing defective signatures toward the tray 22.

In the embodiment of the invention shown in FIGS. 3–5, the rollers 60 and 62 are moved into engagement when the size of the nip 56 is reduced by actuation of the motor 134. However, it is contemplated that the size of the nip may not be reduced this extensively upon actuation of the motor 134. Thus, the size of the nip 56 could be reduced to merely bring the peripheral surfaces of the rollers 60 and 62 into close proximity with each other.

SUMMARY

The present invention provides a new and improved signature handling apparatus 10 having a delivery assembly 18 in which the size of the nip 56 through which groups of signatures 40 are fed is reduced to accommodate defective groups of signatures containing less than a predetermined number of signatures. Once the defective group of signatures has passed through the nip 56, the size of the nip is increased to accommodate the groups of signatures containing the predetermined number of signatures. The delivery assembly 18 includes a pair of rollers 60 and 62 which are disposed on opposite sides of the nip 56. When a defective group of signatures 40 is to be fed through the nip 56, the distance between the rollers 60 and 62 is reduced to decrease the size of the nip.

An apparatus 64 for varying the size of the nip 56 in the delivery assembly 18 includes a cam 90 and cam followers 94 and 96. The cam and cam followers 94 and 96 are relatively movable to adjust the size of the nip 56.

Immediately before a defective group 40 of signatures containing less than the predetermined number of signatures is to pass through the nip 56, the cam 90 and cam followers 94 and 96 move relative to each other to move at least one of the rollers 60 and 62 to decrease the size of the nip 56. Contemporaneously with the reduction in the size of the nip 56, a gate 70 is pivoted from a normal feed position (FIG. 3) to a reject position (FIG. 5) so that the defective group of signatures 40 is directed to a reject location 22 as it leaves the nip 56. Immediately after the defective group of signatures 40 has passed through the nip 56, the cam 90 and cam followers 94 and 96 are moved relative to each other to move at least one of the rollers 60 and 62 and increase the size of the nip 56 back to its original size to accommodate the groups of signatures containing the predetemined number of signatures.

Having described one specific preferred embodiment of the invention, the following is claimed:

1. An apparatus comprising conveyor means for transporting signatures, a plurality of feeder means disposed in an array along said conveyor means for feeding signatures onto said conveyor means to form groups of signatures containing a predetermined number of signatures, detector means for detecting a signature misfeed by one of said feeder means and the formation of a defective group of signatures containing less than the predetermined number of signatures, means for forming a nip through which the groups of signatures are sequentially fed, said means for forming a nip including first and second rollers which are disposed on opposite sides of the nip with the centers of rotation of said rollers spaced a first distance apart during the feeding of groups of signatures containing the predetermined number of signatures, and control means for decreasing the spacing between the centers of rotation of said rollers to feed a defective group of signatures containing less than the predetermined number of signatures in response to said detector means detecting a signature misfeed.

2. An apparatus as set forth in claim 1 further including gate means operable between a first condition in which said gate means is effective to direct signatures exiting from said nip in a first direction and a second condition in which said gate means is effective to direct signatures in a second direction from said nip, said control means including means for operating said gate means from the first condition to the second condition contemporaneously with a decrease in the spacing between the centers of rotation of said rollers so that groups of signatures containing the predetermined number of signatures are directed in the first direction and defective groups of signatures containing less than the predetermined number of signatures are directed in the second direction.

3. An apparatus as set forth in claim 2 wherein said control means includes means for increasing the distance between the centers of rotation of said rollers back to the first distance and for operating said gate means from the second condition to the first condition after passage of a defective group of signatures through the nip.

4. An assembly as set forth in claim 3 wherein said control means includes means for preventing the feeding of signatures onto a defective group of signatures by feeder means downstream of a feeder means at which a misfeed occurs.

5. An apparatus as set forth in claim 2 wherein said gate means includes a first member which is moved through a first arcuate distance to effect operation of said gate means from the first condition to the second condition, said control means including a second member which is moved through a second arcuate distance which is greater than the first arcuate distance to effect movement of said first and second rollers to decrease the spacing between the centers of rotation of said rollers, drive means for effecting movement of said second member through the second arcuate distance upon movement of said first member through the first arcuate distance, and motor means for operating said drive means to move said first and second members immediately prior to feeding of a defective group of signatures to the nip.

6. An apparatus as set forth in claim 5 wherein said drive means includes a relatively large diameter gear mounted for rotation about an axis which extends through the center of rotation of said first member and a relatively small diameter gear which is disposed in meshing engagement with said large diameter gear and is mounted for rotation about an axis which extends through the center of rotation of said second member.

7. An apparatus for feeding a group of signatures containing a selected number of signatures in a first direction and for feeding a group of signatures containing less than the selected number of signatures in a second direction, said apparatus comprising means for forming a variable size nip through which the groups of signatures are sequentially fed, said means for forming a variable size nip including first and second rollers which are disposed on opposite sides of the nip, support means for supporting said first roller for movement toward and away from said second roller to vary the size of the nip, nip control means for adjusting the initial size of said nip to accommodate groups of signatures containing a selected number of signatures, for decreasing the size of the nip from the initial size to a reduced size to accommodate groups of signatures containing less than the selected number of signatures, and for inceasing the size of the nip from the reduced size back to the initial size, said nip control means including a cam, a cam follower connected with said support means and disposed in abutting engagement with said cam, adjustor means for adjusting the initial position of engagement of said cam follower with said cam to locate said first roller in an initial position in which the nip has a size to accommodate groups of signatures containing the selected number of signatures, and drive means for effecting relative movement between said cam and cam follower to change the position of engagement of said cam follower with said cam from the initial position of engagement to a secondary position of engagement and move said first roller from its initial position toward said second roller to decrease the size of the nip to accommodate a group of signatures containing less than the selected number of signatures, a movable gate member disposed adjacent to the nip, and means for supporting said gate member for movement between a first position in which said gate member is effective to direct a group of signatures exiting from the nip in the first direction and a second position in which said gate member is effective to direct said group of signatures exiting from the nip in the second direction, said drive means including means for moving said gate member from its first position to its second position contemporaneously with relative movement between said cam and cam follower from their initial position of engagement to their secondary position of engagement.

8. An apparatus as set forth in claim 7 wherein said drive means includes a first gear connected with said gate member, a second gear connected with said cam and said first gear, said second gear having a diameter which is smaller than the diameter of said first gear, and motor means operable to rotate said first gear through a first arcuate distance to move said gate member from its first position to its second position and operable to rotate said second gear through a second arcuate distance which is greater than said first arcuate distance to rotate said cam to change the position of engagement of said cam follower from the initial position of engagement to the secondary position of engagement.

9. An apparatus as set forth in claim 8 wherein said gate member and first gear are mounted for rotation about a first axis, said cam and second gear being mounted for rotation about a second axis which extends parallel to said first axis, said first and second rollers being rotatable about third and fourth axes which are separate from and parallel to said first and second axes.

10. An apparatus as set forth in claim 7 further including biasing means for urging said cam follower into engagement with said cam.

* * * * *